US007003234B2

(12) United States Patent
Itoh

(10) Patent No.: US 7,003,234 B2
(45) Date of Patent: Feb. 21, 2006

(54) APPARATUS AND METHOD FOR FORMING IMAGE INCLUDING CONTROLLING SUPPLY OF NEW AND RECYCLED TONER

(75) Inventor: Shinichi Itoh, Yokohama (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/968,268

(22) Filed: Oct. 20, 2004

(65) Prior Publication Data

US 2005/0053387 A1 Mar. 10, 2005

Related U.S. Application Data

(63) Continuation of application No. 10/319,621, filed on Dec. 16, 2002, now Pat. No. 6,819,900.

(51) Int. Cl.
*G03G 15/08* (2006.01)

(52) U.S. Cl. ..... 399/27; 399/29; 399/253; 399/258

(58) Field of Classification Search ..... 399/9, 399/24, 25, 27, 29, 75, 252, 253, 254, 256, 399/258, 255
See application file for complete search history.

(56) References Cited

U.S. PATENT DOCUMENTS 5,493,382 A 2/1996 Takagaki et al.
5,583,621 A * 12/1996 Narukawa ..... 399/58
5,592,267 A 1/1997 Misago et al.
5,594,533 A * 1/1997 Katoh ..... 399/61
5,878,317 A 3/1999 Masuda et al.
5,995,790 A * 11/1999 Takeda ..... 399/274
6,226,490 B1 5/2001 Fujita et al.
6,324,356 B1 * 11/2001 Inoue ..... 399/39
6,405,009 B1 6/2002 Shinkawa et al.
6,526,252 B1 2/2003 Itoh et al.
6,577,824 B1 6/2003 Itoh et al.
6,603,949 B1 8/2003 Itoh et al.

FOREIGN PATENT DOCUMENTS

JP 09-185208 * 7/1997
JP 9-281788 10/1997

* cited by examiner

*Primary Examiner*—Hoan Tran
(74) *Attorney, Agent, or Firm*—Foley & Lardner LLP

(57) ABSTRACT

Disclosed is a toner recycle device for supplying recovered toner into a developing device again and reusing it. The ratio of the amount of the recovered toner to be supplied into the developing device to the amount of new toner is arbitrarily increased or reduced. Further, as the remaining amount of the new toner reduces, one or a plurality of the following three processing steps of a toner save mode are executed: (1) to increase the ratio of the amount of the recovered toner, which is supplied into the developing device, to the amount of the new toner; (2) to reduce the total amount of the recovered toner and the new toner to be supplied; and (3) to stop the new toner to be supplied into the developing device and to supply only the recovered toner. Furthermore, an ordinary mode and the toner save mode are automatically switched or arbitrarily switched manually.

12 Claims, 9 Drawing Sheets

APPARATUS AND METHOD FOR FORMING IMAGE INCLUDING CONTROLLING SUPPLY OF NEW AND RECYCLED TONER

The present application is a continuation of U.S. application Ser. No. 10/319,621, filed Dec. 16, 2002, now U.S. Pat. No. 6,819,900 the entire contents of which are incorporated herein by reference.

BACKGROUND OF THE INVENTION

The present invention relates to an image forming apparatus and an image forming method of supplying recovered toner into a developing device and reusing it, and they can be applied to an image forming apparatus and the like of, for example, a copy machine, printer, facsimile, and the like.

An image forming apparatus having a toner recycle device executes an image forming process such that the surface of a photosensitive drum is charged negatively, a latent image is formed by exposing the photosensitive drum with laser beams based on an image signal (a surface is charged with a potential), a visible image is formed by causing the latent image to absorb negatively charged toner, and the visible image is transferred onto a positively charged sheet and fixed thereon.

In the above image formation, toner, which was already used for image formation and collected for recycle (hereinafter, referred to as "recovered toner"), and new toner, which is not yet used for image formation (hereinafter, referred to as "new toner"), are used in mixture. That is, the recovered toner is recycled. The recovered toner is recycled by a toner recycle device.

A conventional toner recycle device is controlled to replenish recovered toner within a range in which a stable image is not damaged. That is, the toner recycle device is controlled to form an image stably by automatically changing the amount of the recovered toner to be replenished by, for example, reducing the amount of the recovered toner or stopping the supply of the recovered toner in accordance with a set value of the toner ratio density of an developing agent in a developing device.

In contrast, there is a case in which it is desired to make a large number of copies at any cost regardless of that new toner remains in a very small amount (new toner remains in a small amount) and that spare new toner is not available at hand. Even in such a case, however, the copies must be waited until the spare new toner is obtained.

SUMMARY OF THE INVENTION

An object of the present invention is to extend a period until toner is exhausted by reducing the amount of consumption of new toner when the new toner remains in a small amount or when it is desired to save the new toner. That is, the object of the present invention is to extend the period until the toner is exhausted by selecting a new toner saving mode by the intention of a user or automatically without waiting for spare new toner even in a case in which it is desired to make copies in a large amount after the amount of the new toner is greatly reduced, and the like. Further, when the user desires to save the amount of consumption of the new toner as mush as possible while he or she does not place greater emphasis on the quality of an image as long as characters can be read, the user extends the period until the toner is exhausted by selecting the new toner saving mode by his or her intention. In contrast, another object of the present invention is to execute a scattering of toner prevention means because the toner is scattered in an increased amount when recovered toner is supplied in a large amount to save the new toner.

The image forming apparatus and the image forming method of the present invention, which have been made to achieve the above objects, reduce the amount of the new toner to be supplied into a developing device. Further, as the remaining amount of the new toner to be supplied into the developing device reduces, the image forming apparatus and the image forming method execute one or a plurality of the following three processing steps of a toner save mode: (1) to increase the ratio of the amount of the recovered toner to be supplied to the amount of the new toner while maintaining the total amount of the recovered toner and the new toner to be supplied into the developing device constant; (2) to reduce the total amount of the recovered toner and the new toner to be supplied; and (3) to stop the new toner to be supplied into the developing device and to supply only the recovered toner.

Further, as the remaining amount of the new toner reduces, an ordinary mode, in which the recovered toner having a preset mixing ratio is mixed with the new toner and reused, is automatically switched or arbitrarily switched manually to the toner save mode.

Furthermore, it is preferable, when the toner save mode is selected, to execute any one or both of means for reducing the rotational speed of a magi-roller of the developing device to prevent the scattering of the toner and means for increasing the amount of charge of the toner so that the toner can be easily absorbed by a latent image on the surface of a photosensitive drum. Further, the timing at which the remaining amount of the new toner is reduced, that is, the timing at which the above processing steps are executed, is preferably the timing at which it is determined that the new toner is remains in a small amount.

DESCRIPTION OF THE PREFERRED EMBODIMENTS

Figure 1:
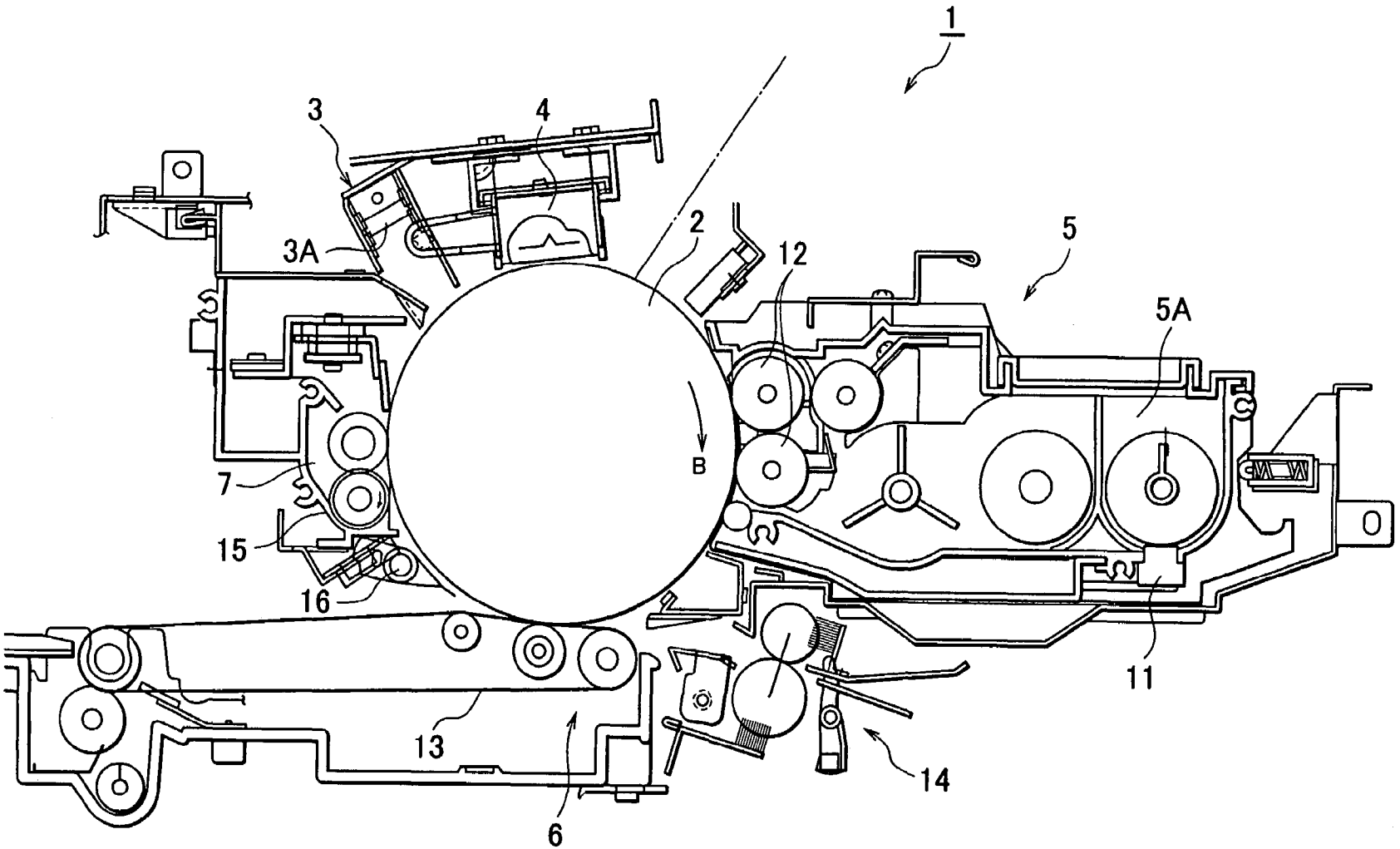
FIG. 1 is a schematic front elevational view showing a main portion of an image forming apparatus of an embodiment of the present invention.

An embodiment of an image forming apparatus and a set-up method according to the present invention will be described below. In the following description, it is assumed that the image forming apparatus of the embodiment is installed on a copying machine. The image forming apparatus assembled in the copying machine is an apparatus for creating an image and transferring the image onto a sheet by a reverse development system based on a document to be copied. An overall structure of the image forming apparatus will be described based on FIGS. 1 to 3.

The image forming apparatus 1 is mainly composed of a photosensitive drum 2, a discharging unit 3, an electrifying charger 4, a developing device 5, a transfer unit 6, a cleaner unit 7, a new toner replenishment device 8 as new toner supply means, and a toner recycle device 9.

The photosensitive drum 2 is a cylindrical drum rotating in one direction (a clockwise direction, that is, a direction of an arrow B in FIG. 1). The photosensitive drum 2 has a surface the charged state of which can be arbitrarily adjusted with laser beams. With this arrangement, an image and the like as data to be transferred can be formed on the surface of the photosensitive drum 2 as a latent image by appropriately adjusting the charged state of an arbitrary portion of the surface of the photosensitive drum 2.

The discharging unit 3 is used to remove charge of the surface of the photosensitive drum 2. The discharging unit 3 includes a discharging lamp 3A. The charge remaining on the surface of the photosensitive drum 2 is entirely removed by impinging the light from the charge removing lamp 3A on the surface, thereby the image forming apparatus prepares for the next print.

The electrifying charger 4 is used to charge the surface of the photosensitive drum 2. The surface of the photosensitive drum 2 negatively charged by the electrifying charger 4 is exposed by the laser beams irradiated from a laser unit (not shown), thereby the latent image is formed on the surface. That is, the surface of the photosensitive drum 2 is exposed with the laser beams based on input information such as an image of a document and the like and a surface potential approaches to zero according to the density of the image and the like, thereby the latent image is formed.

The developing device 5 is a device for adhering a suitable amount of toner onto the surface of the charged photosensitive drum 2. Since a two-component development system is employed here, a carrier and toner are accommodated in the developing device 5, and the ratio of the toner to the carrier is adjusted to about 5 wt %: about 95 wt %. Specifically, the new toner replenishment device 8 and the toner recycle device 9 are appropriately controlled so as to adjust the ratio of the toner to the carrier. The amount of the toner in the developing device 5 is monitored by an automatic toner sensor 11 at all times. When the amount of the toner in the developing device 5 is less than 5 wt %, the new toner replenishment device 8 and the toner recycle device 9 are appropriately controlled by a control unit 70, which will be described later, and a necessary amount of the toner is replenished. The replenished toner and the carrier are stirred by a mixer unit 5A in the developing device 5, and the toner is negatively charged by friction charge when it is stirred. The negatively charged toner is transferred onto the surface of the photosensitive drum 2 by a mag-roller 12 and absorbed by the latent image, thereby a visible image is formed.

The transfer unit 6 is used to transfer the toner, which is absorbed by the latent image on the surface of the photosensitive drum 2, onto a sheet. The transfer unit 6 is mainly composed of a transfer belt 13 and a sheet supply unit 14. The transfer belt 13 transfers and supports the sheet so that sheet comes into contact with the surface of the photosensitive drum 2 and transfers the visual image onto the sheet. The sheet supply unit 14 is disposed so as to face a portion where the transfer belt 13 is in contact with the photosensitive drum 2. The sheet, which is supplied from the sheet supply unit 14 to the portion where the transfer belt 13 is in contact with the photosensitive drum 2, is positively charged and absorbs the negatively charged toner forming the visual image. The sheet onto which the toner has been transferred is supplied to a fixing unit (not shown), and the toner is fusion bonded onto the sheet by thermo compression.

The cleaner unit 7 is used to clean the surface of the photosensitive drum 2. The cleaner unit 7 removes the toner remaining on the surface of the photosensitive drum 2 after the toner has been transferred onto the sheet by the transfer unit 6. The cleaner unit 7 includes a toner receiver 15 and a discharge auger 16 for discharging the toner removed from the surface of the photosensitive drum 2 to the outside. The toner having been removed from the surface of the photosensitive drum 2 drops onto the toner receiver 15 and is discharged to the toner recycle device 9 side by the discharge auger 16.

Figure 2:
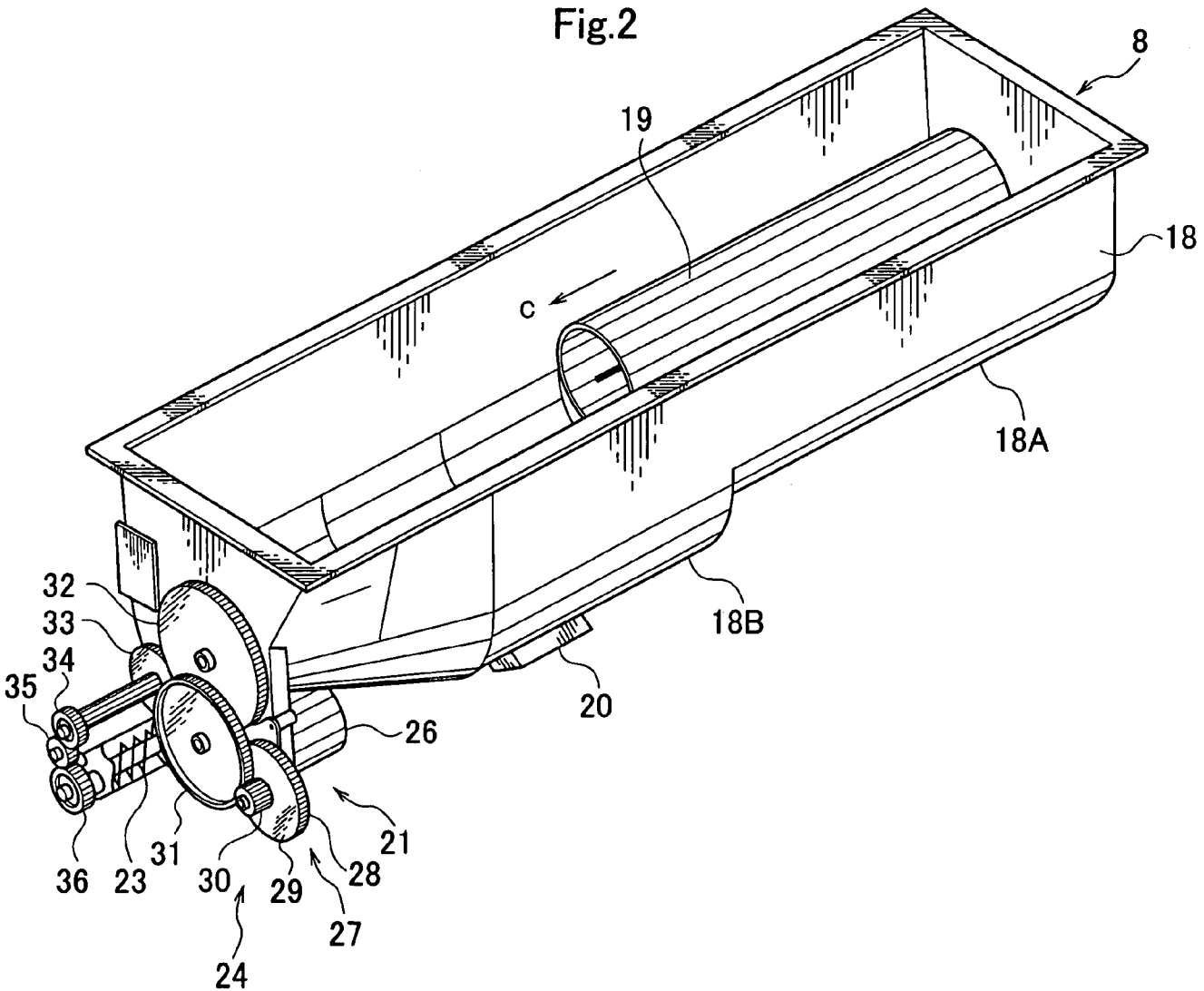
FIG. 2 is a perspective view showing a new toner replenishment device of the embodiment.
Figure 3:
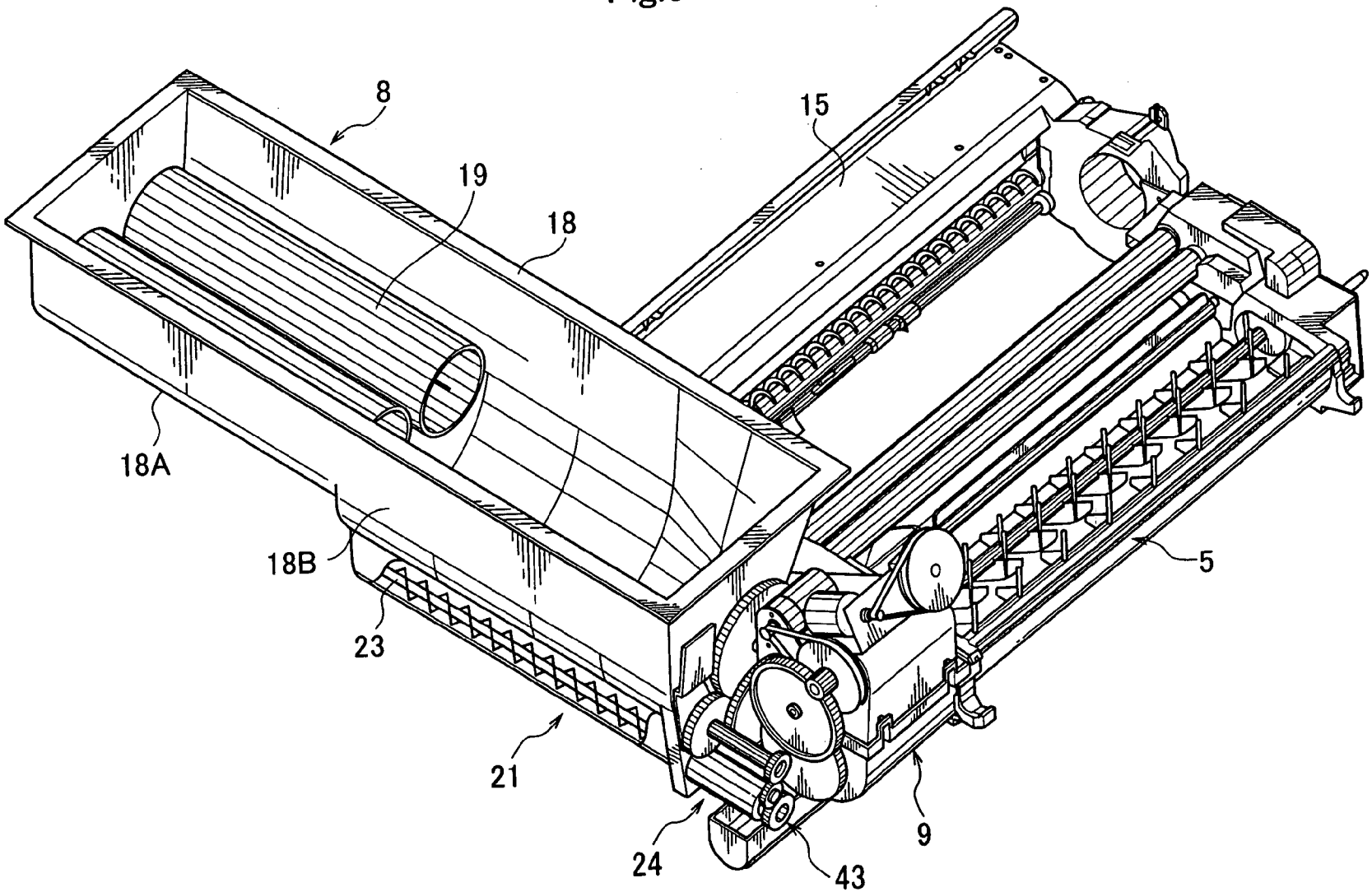
FIG. 3 is a perspective view showing the image forming apparatus of the embodiment.
Figure 4:
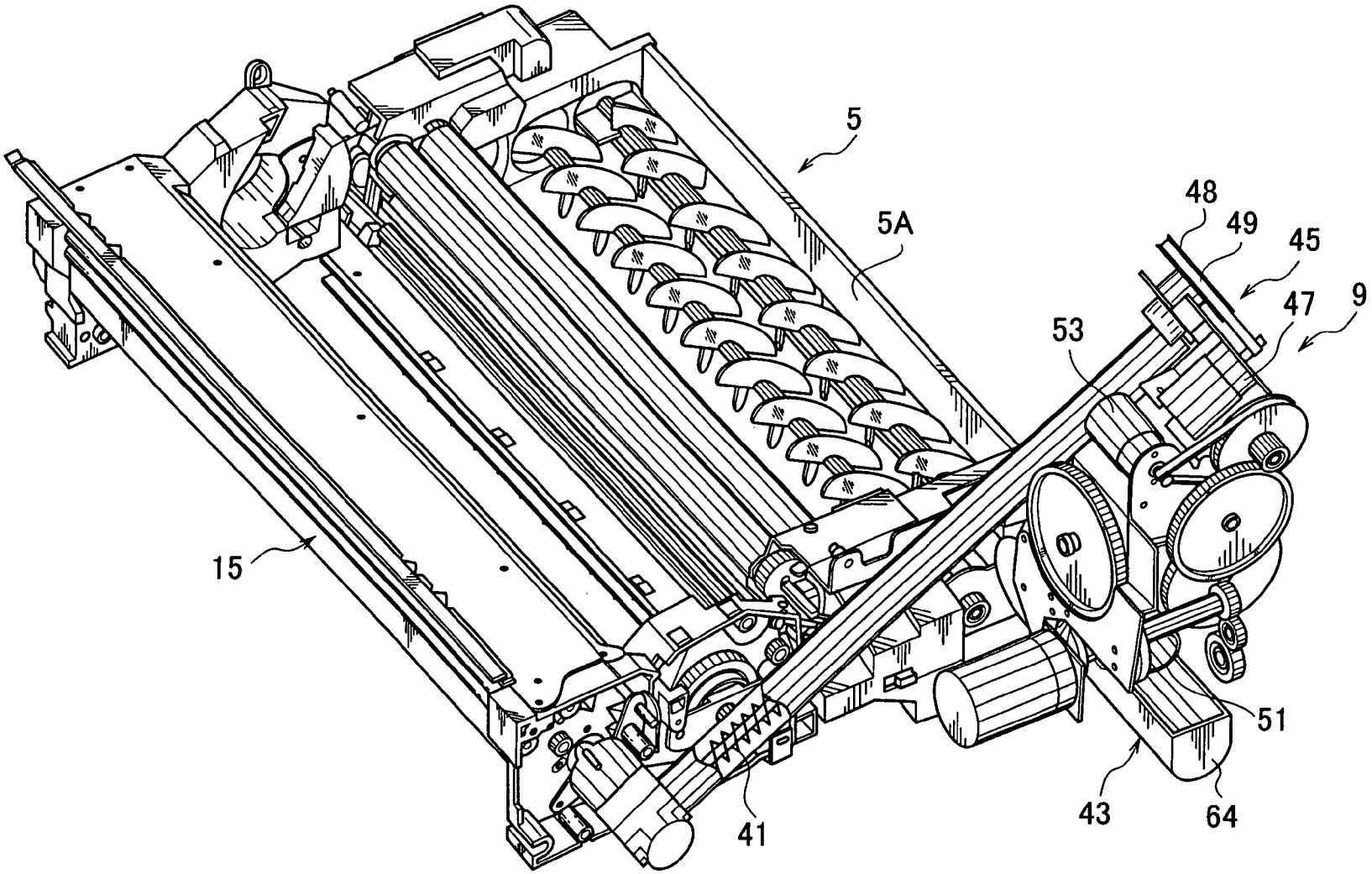
FIG. 4 is a perspective view showing the image forming apparatus of the embodiment excluding the new toner replenishment device.
Figure 5:
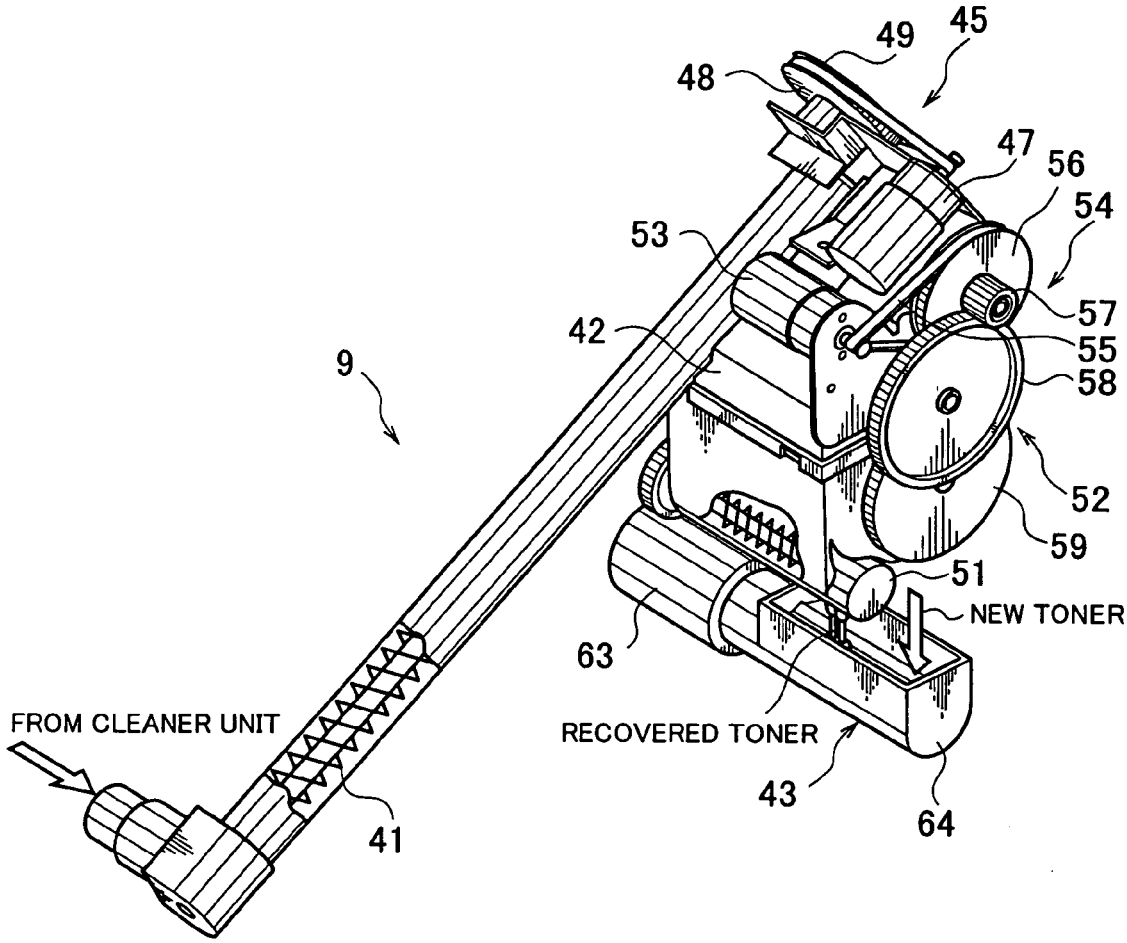
FIG. 5 is a perspective view showing a toner recycle device of the embodiment.
Figure 6:
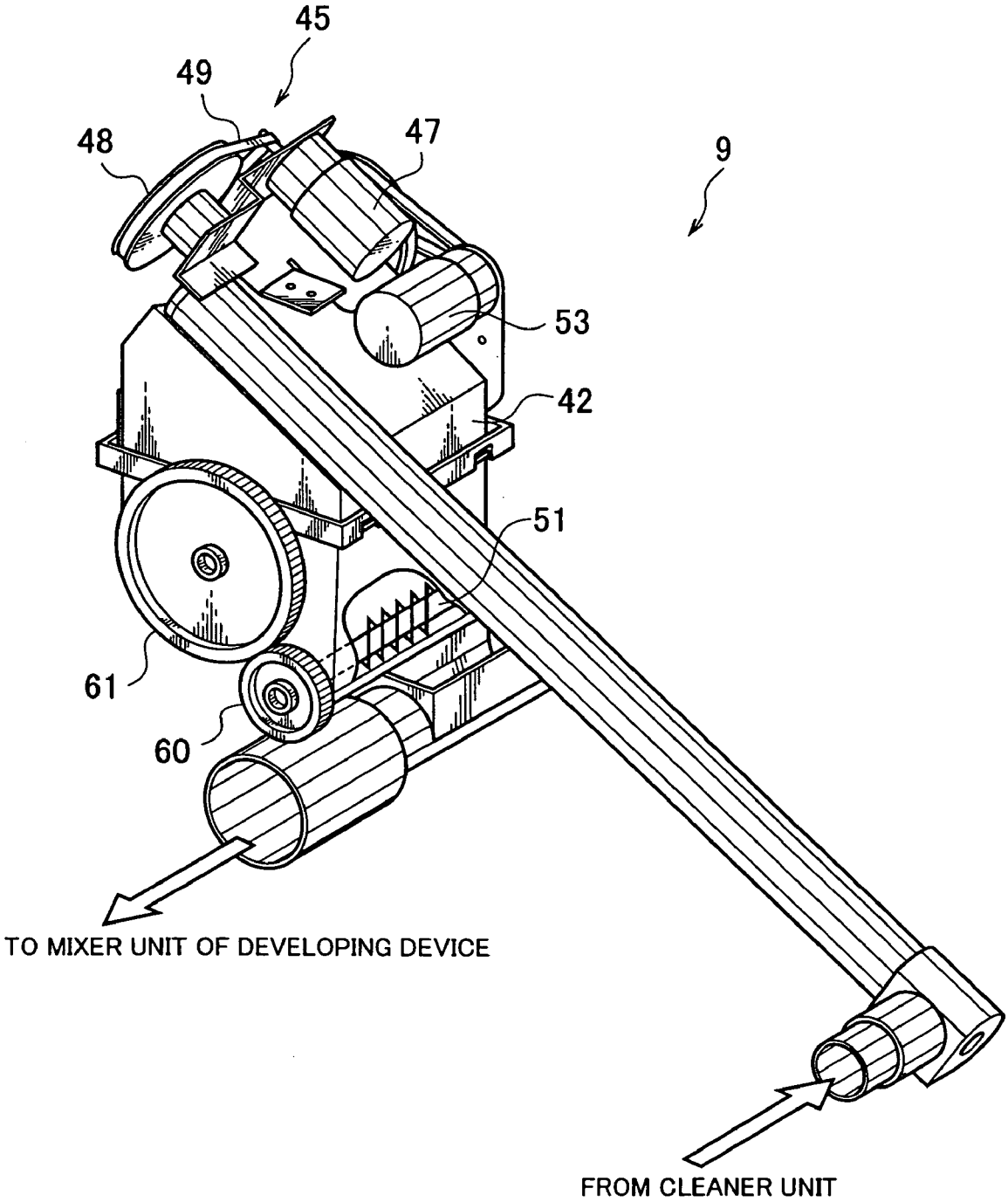
FIG. 6 is a perspective view showing the toner recycle device of the embodiment from a view point different from that of FIG. 5.

The new toner replenishment device 8 is a device for replenishing new toner into the developing device 5. As shown in FIGS. 2 and 3, the new toner replenishment device 8 is disposed in a direction perpendicular to the developing device 5. In this state, the new toner replenishment device 8 is disposed forward of a front surface a main body of the copying machine. The new toner replenishment device 8 is composed of a new toner hopper 18, stir and transfer paddles 19, a remaining toner detection sensor 20, and a conveying unit 21.

The new toner hopper 18 is a vessel for storing new toner. The new toner hopper 18 is composed of an approximately semi-circular vessel having an upper open side. The semi-circular new toner hopper 18 is divided into a shallow bottom section 18A and a deep bottom section 18B at the center of a longitudinal direction. Two sets of the stir and transfer paddles 19 are disposed in the shallow bottom section 18A in parallel with each other. The remaining toner detection sensor 20 and the conveying unit 21 are disposed in the deep bottom section 18B.

The stir and transfer paddles 19 are devices for transferring the new toner stored in the new toner hopper 18 to the conveying unit 21 while stirring it. As described above, the two sets of the stir and transfer paddles 19 are disposed in the shallow bottom section 18A in parallel with each other. When the two stir and transfer paddles 19 rotate, the new toner in the new toner hopper 18 is transferred to the conveying unit 21 in the deep bottom section 18B. The respective stir and transfer paddles 19 are driven by a drive unit (not shown).

The remaining toner detection sensor 20 is a sensor for detecting the remaining amount of the new toner stored in the new toner hopper 18. Since an image cannot be formed if the toner is exhausted, the remaining amount of the toner is detected by the remaining toner detection sensor 20 at all times. Any know sensors such as a magnetic sensor, optical sensor, and the like can be applied to the remaining toner detection sensor 20. They are appropriately selected depending on an accuracy with which the remaining toner is detected.

The conveying unit 21 is used to supply the new toner stored in the new toner hopper 18 into the developing device 5. The conveying unit 21 is composed of a toner transfer auger 23 and an auger drive unit 24. The toner transfer auger 23 is composed of a screw conveyer and disposed on the bottom of the deep bottom section 18B in parallel with the new toner hopper 18. The toner transfer auger 23 is disposed to face a toner receiving plate 64, which will be described later, and supplies the new toner stored in the new toner hopper 18. The auger drive unit 24 is composed of a drive motor (hereinafter, referred to as a "toner hopper motor") 26 and a reducer 27. The toner hopper motor 26 is composed of, for example, a stepping motor. The amount of the new toner to be supplied is accurately controlled by controlling the number of rotation and the period of time of rotation of the toner transfer auger 23 by the toner hopper motor 26. The reducer 27 is composed of a belt 28, a pulley 29, and gears 30 to 36. The gears 30 to 36 are appropriately regulated according to a speed reduction ratio. Stirring bars (not shown) disposed in the deep bottom section 18B are attached to a rotating shaft of the gear 32.

The toner recycle device 9 is used to transfer the recovered toner collected by the cleaner unit 7 to the developing device 5 in order to reuse it. The toner recycle device 9 is disposed below the new toner replenishment device 8 approximately in parallel with it. As shown in FIGS. 3 to 6, the toner recycle device 9 is composed of a recovered toner coupling and transfer auger 41 acting as a coupling and transfer unit, a recovered toner sub-hopper 42 acting as recovered toner accommodation means, and a supply auger 43.

The recovered toner coupling and transfer auger 41 is used to transfer the toner collected by the cleaner unit 7 to the developing device 5 side. The recovered toner coupling and transfer auger 41 is composed of, for example, a long screw conveyer, the lower end of the auger 41 is coupled with the discharge auger 16 of the cleaner unit 7, and the upper end thereof is coupled with the recovered toner sub-hopper 42. A drive unit 45 of the recovered toner coupling and transfer auger 41 is composed of a drive motor 47 disposed adjacent to the upper end of the recovered toner coupling and transfer auger 41, a pulley 48 coupled with the recovered toner coupling and transfer auger 41, a belt 49 for coupling the drive motor 47 with the pulley 48, and the like. The drive motor 47 is controlled in association with a drive motor of the discharge auger 16 of the cleaner unit 7.

The recovered toner sub-hopper 42 is a vessel for temporarily storing the recovered toner collected by the recovered toner coupling and transfer auger 41 and supplying a necessary amount of it into the developing device 5. Stirring bars (not shown) are disposed in the recovered toner sub-hopper 42 to stir the recovered toner stored therein. A recovered toner replenishment auger 51 acting as recovered toner replenishment means is disposed to the lower portion in the recovered toner sub-hopper 42. The rotation of the recovered toner replenishment auger 51 is controlled by a drive unit 52 so that the recovered toner can be supplied to the supply auger 43 in an accurate amount. The drive unit 52 is composed of a drive motor (sub-hopper motor) 53 and a reducer 54. The sub-hopper motor 53 is composed of, for example, a stepping motor. The reducer 54 is composed of a combination of a belt 55, a pulley 56, and gears 57 to 61. The gears 59 and 60 are disposed on both the sides of the recovered toner sub-hopper 42 across it and coupled with each other through a single rotating shaft, and stir bars (not shown) are attached to the rotating shaft.

The supply auger 43 is used to receive the recovered toner from recovered toner replenishment auger 51 and the new toner from the toner transfer auger 23 of the new toner replenishment device 8 and supplies them into the developing device 5. The supply auger 43 is composed of an auger unit 63 formed by being extended from the mixer unit 5A of the developing device 5, the recovered toner replenishment auger 51 of the toner recycle device 9, and a toner receiving plate 64 that opens toward the toner transfer auger 23 of the new toner replenishment device 8. A drive motor (not shown) of the auger unit 63 is disposed on the developing device 5 side. The recovered toner replenishment auger 51 is disposed on the developing device 5 side. In the toner receiving plate 64, the new toner from the toner transfer auger 23 of the new toner replenishment device 8 is supplied upstream of the recovered toner from the recovered toner replenishment auger 51. The new toner and the recovered toner having been replenished to the toner receiving plate 64 are mixed with a carrier and stirred in the mixer unit 5A of the developing device 5.

Figure 7:
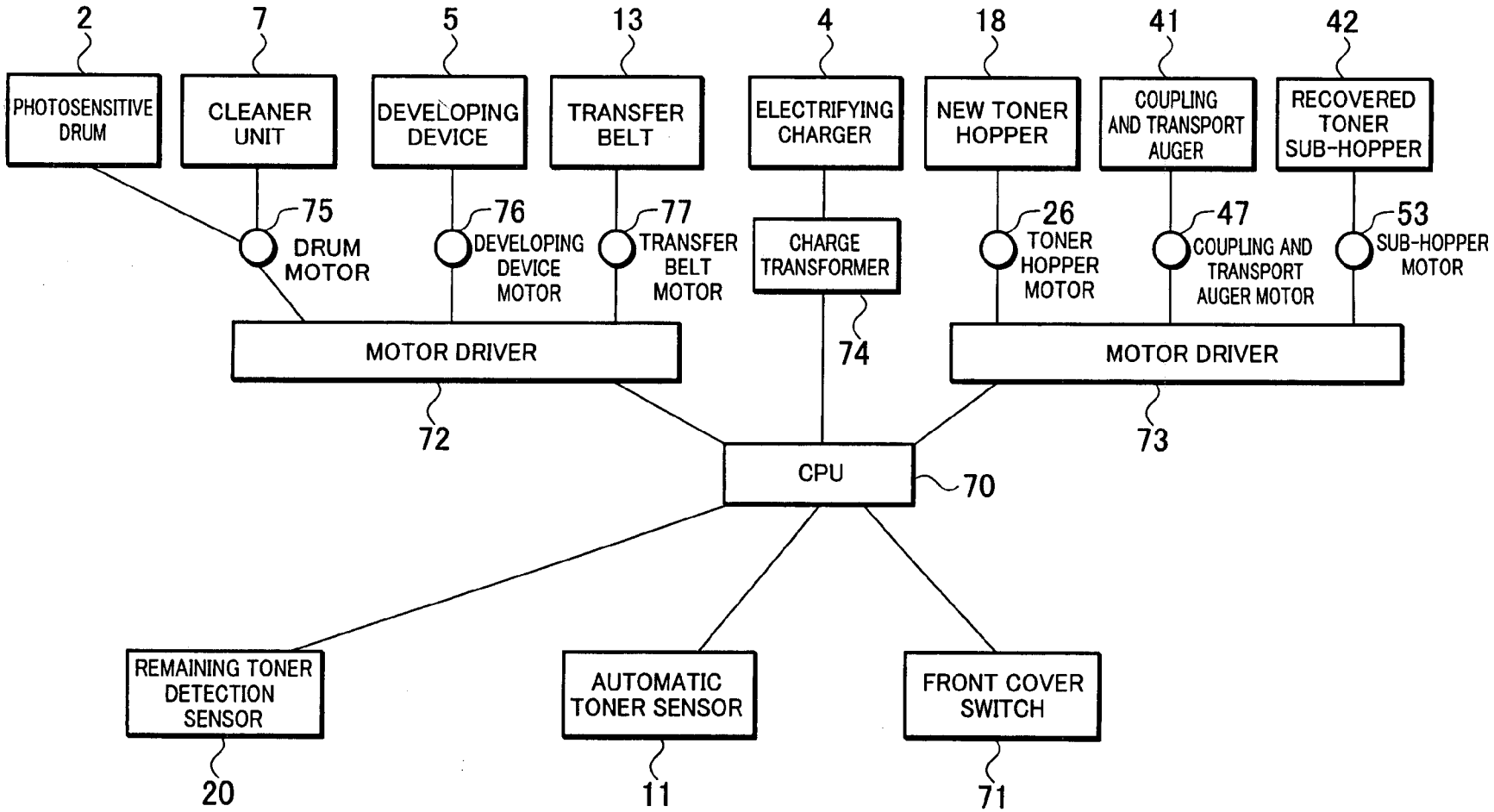
FIG. 7 is a block diagram showing a control arrangement of the image forming apparatus of the embodiment.

FIG. 7 is a block diagram showing a control arrangement of the image forming apparatus 1 of the embodiment.

A controller (shown as a CPU in FIG. 7) 70 is composed of, for example, a CPU, ROM, RAM, and the like and controls the image forming apparatus 1 in its entirety based on a processing program stored in the ROM, RAM, and the like and according to data stored in the ROM, RAM, and the like and to the outputs from various sensors.

The remaining toner detection sensor 20 and the automatic toner sensor 11 described above are connected to input ports of the controller 70 as well as a front cover switch 71 is connected to the sensor 20.

The remaining toner detection sensor 20 detects the amount of the new toner remaining in the new toner hopper 18 as described above, and a magnetic sensor composed of a magnet and a lead switch, for example, can be applied to the remaining toner detection sensor 20. When the new toner remains in a large amount, the new toner enters between the magnet and the lead switch and a gap is formed therebetween, thereby the lead switch is turned off. In contrast, when the new toner remains in a small amount, no gap is formed therebetween, thereby the lead switch is turned on by the attracting force of the magnet. The controller 70 detects the turning-on and the turning-off of the lead switch.

The automatic toner sensor 11 is a toner density ratio sensor for detecting the ratio of the toner (resin) to the carrier (iron) in a developing agent, as described above. The output from the automatic toner sensor 11 is read by the controller 70. When a toner density drops, the controller 70 drives the toner hopper motor 26 and the like so that the toner is replenished into the developing device 5 and notifies a user of a lack of toner, and the like by displaying it on a control panel (not shown) and the like.

The front cover switch 71 is a switch that is turned on and off by opening and closing a main body cover (here, referred to as a "front cover") of the copying machine. The output signal from the front cover switch 71 is read by the controller 70, thereby the controller 70 recognizes a state of the front cover.

The output ports of the controller 70 are connected to the two motor drivers 72, 73 and a charge transformer 74.

The photosensitive drum 2 and the cleaner unit 7 are driven by a drum motor 75, which is driven in rotation by the motor driver 72, under the control of the controller 70 when a copy or the like is executed.

Likewise, the developing device 5 and the transfer belt 13 are driven by a developing device motor 76 and a transfer belt motor 77, which are driven in rotation by the motor driver 72, under the control of the controller 70 when the copy or the like is executed.

Further, likewise, the new toner hopper 18, the recovered toner coupling and transfer auger 41, and the recovered toner sub-hopper 42 are driven by the toner hopper motor 26, the coupling and transfer auger motor 47, and the sub-hopper motor 53, respectively, which are driven in rotation by the motor driver 73.

Note that while the toner hopper motor 26, the coupling and transfer auger motor 47, and the sub-hopper motor 53 are connected to the same motor driver 73, they can be driven individually under the control of the controller 70.

As described above, the electrifying charger 4 is applied with a high voltage by the charge transformer 74 under the control of the controller 70 and charges the photosensitive drum 2 when the copy and the like are made.

Figure 8:
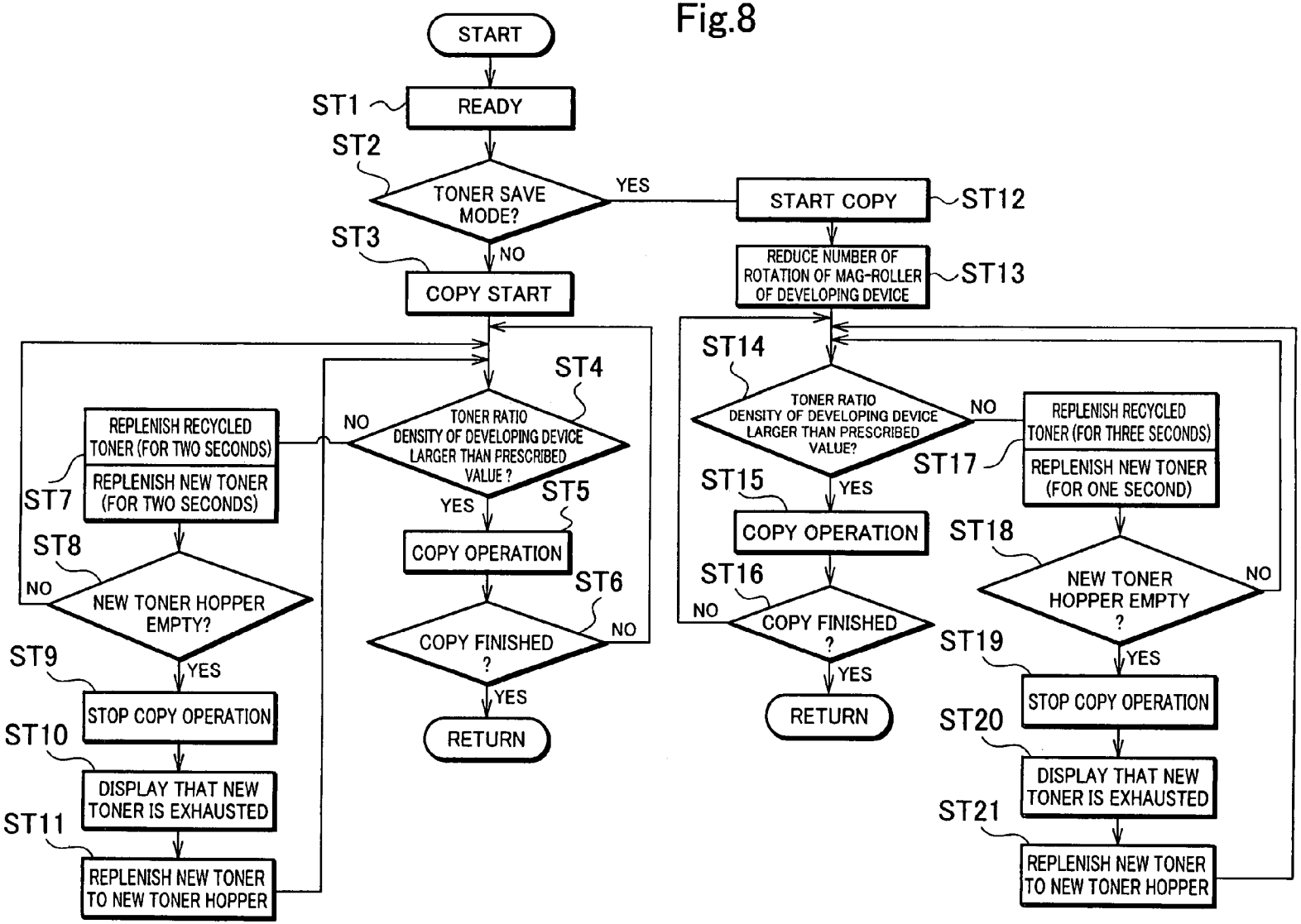
FIG. 8 is a flowchart showing an image forming operation of the image forming apparatus of the embodiment.
Figure 9:
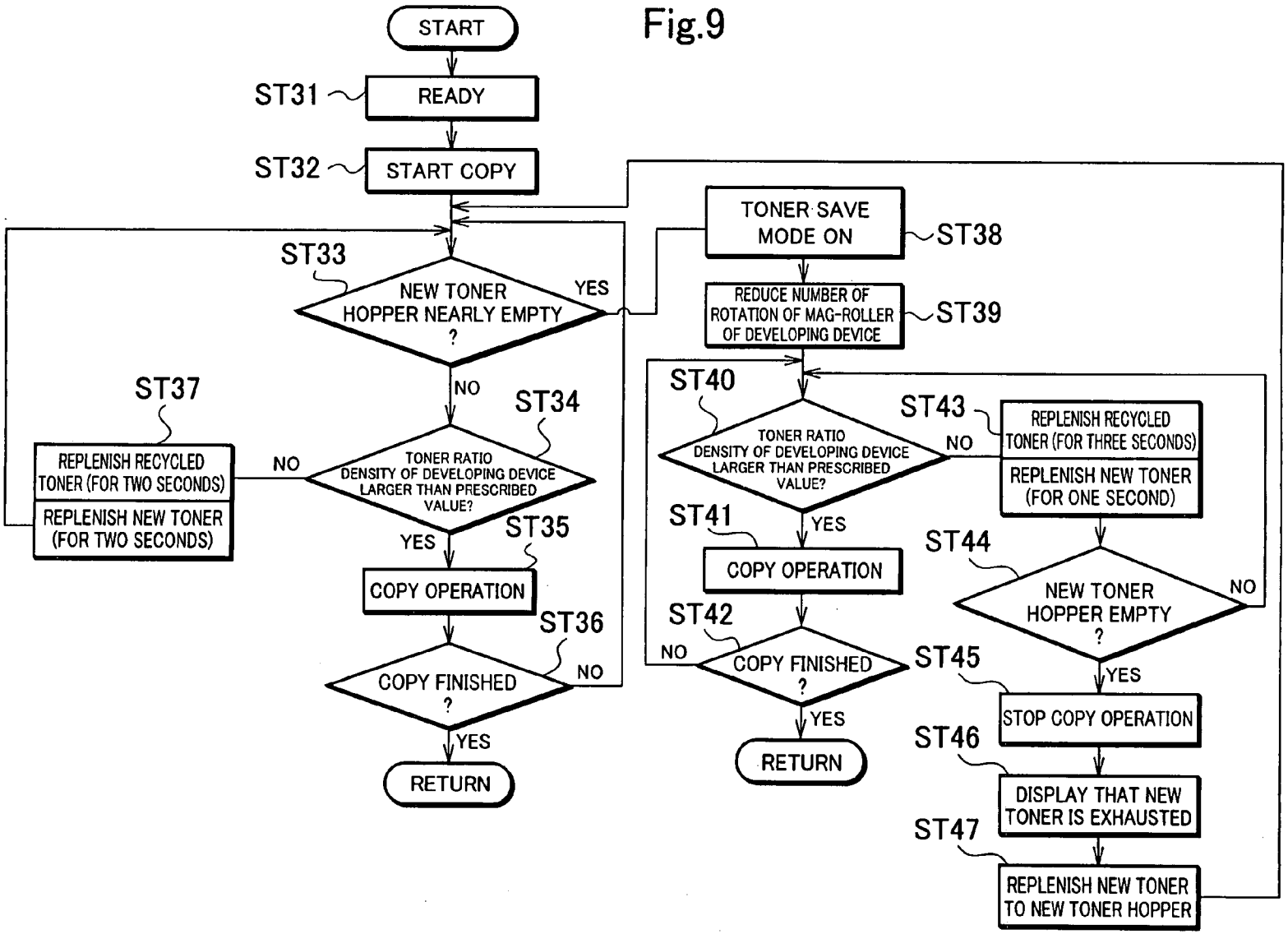
FIG. 9 is a flowchart showing an image forming operation of an image forming apparatus of a second embodiment of the present invention.

In addition, the processing functions shown in flowcharts of FIGS. 8 and 9 are stored in the controller 70.

Further, a toner save mode switch button (not shown) acting as toner save mode setting means is disposed on the control panel (not shown) to switch the control modes of the controller 70. Note that when the control panel is composed of a touch panel, the toner save mode switch button is composed of an icon.

An ordinary mode and a toner save mode are arbitrarily switched manually by means of the toner save mode switch button. In the ordinary mode, the recovered toner having a preset mixing ratio is mixed with the new toner and reused. Whereas, the toner save mode includes any one or two or more of a case in which the ratio of the amount of the recovered toner to be supplied to the new toner is increased while maintaining the total amount of the recovered toner and the new toner to be supplied into the developing device 5 constant, a case in which the total amount of the recovered toner and the new toner to be supplied is reduced, and a case in which the new toner to be supplied into the developing device 5 is stopped and only the recovered toner is supplied.

Moreover, a control mode switch button (not shown) is disposed on the control panel to appropriately select a manual switch control shown in FIG. 8 and an automatic switch control shown in FIG. 9. A user, a service person, and the like switch the control mode switch button to the manual control of FIG. 8 so that the toner save mode switch button works or to the automatic control of FIG. 9 so that the toner save mode switch button does not work.

Next, a toner recycle method using the toner recycle device 9 will be described. Since the toner recycle device 9 is described here using the copy machine as an example, a toner recycle method while the copy machine is in operation will be described. FIG. 8 is a flowchart showing an image forming operation executed by the image forming apparatus 1. Note that the control mode switch button is switched to the manual switch control side shown in FIG. 8. With this arrangement, the user can arbitrarily select the toner save mode by switching the toner save mode switch button on the control panel.

After turning on the main switch, the user selects whether a copy is made in the ordinary mode or in the toner save mode. When the copy is made in the toner save mode, the user presses the toner save mode switch button on the control panel to switch it to the toner save mode. Next, the user sets a document and presses a start button. With this operation, the controller 70 executes the following processing steps.

First, when the main switch is turned on, the process is placed in a waiting state in which the electrifying charger 4 and the like can be operated (step ST1). Next, it is determined whether or not the toner save mode switch button on the control panel is pressed by the user (step ST2).

When the toner save mode switch button is not pressed, the image forming apparatus is operated in the ordinary mode. In the ordinary mode, the process waits for the copy start button to be pressed by the user (step ST3), and it is determined whether or not the toner ratio density in the developing device 5 is equal or more than a prescribed value (step ST4). When the toner ratio density is equal to or more than the prescribed value, a first copy is made (step ST5), and it is determined whether or not a copy operation is finished (step ST6). When the copy operation is finished, the process returns to the waiting state at step ST1. When the copy operation is not finished, the process repeats the processing steps from steps ST4 to ST6.

In contrast, when it is determined at step ST4 that the toner ratio density in the developing device 5 is not more than the prescribed value, the recovered toner replenishment auger 51 of the toner recycle device 9 is operated for two seconds to thereby supply the recovered toner in the recovered toner sub-hopper 42 to the supply auger 43 as well as the toner transfer auger 23 of the new toner replenishment unit 8 is operated for two seconds to thereby supply the new toner in the new toner hopper 18 to the supply auger 43 (step ST7). With this operation, the supply auger 43 replenishes the recovered toner and the new toner into the developing device 5 at the same mixing ratio.

Next, it is determined whether or not the new toner hopper 18 containing the new toner is empty (step ST8). When the new toner hopper 18 is not empty, the process returns to step ST4 and determines whether or not the toner ratio density in the developing device 5 is equal to or more than the prescribed value. The process returns the toner ratio density to at least the prescribed value by repeating steps ST4, ST7, and ST8.

In contrast, when it is determined at step ST8 that the new toner hopper 18 containing the new toner is empty, the copy operation is stopped (step ST9), and it is displayed that the new toner hopper containing the new toner is empty (step ST10). Next, the process waits until new toner is replenished in the new toner hopper 18 (step ST11), and when the new toner is replenished, the process returns to step ST4 and repeats the above processing steps.

In contrast, when the toner save mode switch button is pressed at step ST2, the image forming apparatus is operated in the toner save mode. The process waits for the copy start button to be pressed by the user (step ST12), and the number of rotation of the mag-roller 12 of the developing device 5 is reduced (step ST13). When the mag-roller 12 is rotated at an ordinary number of rotation, the mixing ratio of the recovered toner is increased and the developing agent is liable to scatter. Thus, the number of rotation of the mag-roller 12 is reduced by several percents than the ordinary number of rotation.

Next, it is determined whether or not the toner ratio density in the new toner hopper 5 is equal to or more than the prescribed value (step ST14). When the toner ratio density is equal to or more than the prescribed value, a first copy is made (step ST15), and it is determined whether or not a copy operation is finished (step ST16). When the copy operation is finished, the process returns to the waiting state at step ST1. When the copy operation is not finished, the process repeats the processing steps from step ST14 to ST16.

In contrast, when it is determined at step ST14 that the toner ratio density in the developing device 5 is not more than the prescribed value, the recovered toner replenishment auger 51 of the toner recycle device 9 is operated for three seconds to thereby supply the recovered toner in the recovered toner sub-hopper 42 to the supply auger 43 as well as the toner transfer auger 23 of the new toner replenishment unit 8 is operated for one second to thereby supply the new toner in the new toner hopper 18 to the supply auger 43 (step ST17). With this operation, the supply auger 43 replenishes the recovered toner and the new toner into the developing device 5 at a mixing ratio of 3:1.

Next, it is determined whether or not the new toner hopper 18 containing the new toner is empty 18 (step ST18). When the new toner hopper 18 is not empty, the process returns to step ST14 and determines whether or not the toner ratio density in the developing device 5 is equal to or more than the prescribed value. The process returns the toner ratio density to at least the prescribed value by repeating the steps ST14, ST17, and ST18.

In contrast, when it is determined at step ST18 that the new toner hopper 18 containing the new toner is empty, the copy operation is stopped (step ST19), and it is displayed that the new toner hopper containing the new toner is empty (step ST20). Next, the process waits until new toner is replenished in the new toner hopper 18 (step ST21), and when the new toner is replenished, the process returns to step ST14 and repeats the above processing steps.

With the above operation, even if the new toner remains in a small amount and spare new toner is not available at hand, a period until the toner is exhausted can be extended by selecting the toner save mode. Accordingly, a large amount of copies can be made even after the new toner is reduced to a small amount.

Further, even if the new toner remains in a sufficient amount, the user can arbitrarily select an ordinary operation, in which the new toner is used for an ordinary period of time while maintaining an ordinary image quality, and a long period operation, in which the new toner is used for an extended period of time while an image quality is somewhat deteriorated.

Next, a second embodiment of the present invention will be described. The second embodiment is controlled such that when it is detected in the copy machine of the first embodiment that the new toner hopper 18 containing the new toner is almost empty, the toner save mode is automatically turned on. For this purpose, the user, the serviceman, and the like switch the control mode switch button to the automatic control side of FIG. 9 so that the toner save mode switch button does not work.

The user turns on the main switch, sets a document, and presses the start button. With this operation, the controller 70 executes the following processing steps. Note that FIG. 9 is a flowchart showing an image forming operation according to the second embodiment.

First, when the main switch is turned on, the process is placed in a waiting state in which the electrifying charger 4 and the like can be operated (step ST31). Next, when the user presses the copy start button (step ST32), it is determined Whether or not the new toner hopper 18 containing the new toner is almost empty (step ST33). When the new toner hopper 18 is not almost empty, it is determined whether or not the toner ratio density in the new toner hopper 5 is equal to or more than the prescribed value (step ST34). When the toner ratio density is equal to or more than the prescribed value, a first copy is made (step ST35), and it is determined whether or not a copy operation is finished (step ST36). When the copy operation is finished, the process returns to the waiting state at step ST31. When the copy operation is not finished, the process repeats the processing steps from steps ST33 to ST36.

In contrast, when it is determined at step ST34 that the toner ratio density in the developing device 5 is not more than the prescribed value, the recovered toner replenishment auger 51 of the toner recycle device 9 is operated for two seconds to thereby supply the recovered toner in the recovered toner sub-hopper 42 to the supply auger 43 as well as the toner transfer auger 23 of the new toner replenishment unit 8 is operated for two seconds to thereby supply the new toner in the new toner hopper 18 to the supply auger 43 (step ST37). With this operation, the supply auger 43 replenishes the recovered toner and the new toner into the developing device 5 at the same mixing ratio.

In contrast, when it is determined at step ST33 that the new toner hopper 18 containing the new toner is almost empty, the toner save mode is turned on (step ST38), and the number of rotation of the mag-roller 12 of the developing device 5 is reduced by several percents (step ST39).

Next, it is determined whether or not the toner ratio density in the new toner hopper 5 is equal to or more than the prescribed value (step ST40). When the toner ratio density is equal to or more than the prescribed value, a first copy is made (step ST41), and it is determined whether or not a copy operation is finished (step ST42). When the copy operation is finished, the process returns to the waiting state at step ST31. When the copy operation is not finished, the process repeats the processing steps from steps ST40 to ST42.

In contrast, when it is determined at step ST40 that the toner ratio density in the developing device 5 is not more than the prescribed value, the recovered toner replenishment auger 51 of the toner recycle device 9 is operated for three seconds to thereby supply the recovered toner in the recovered toner sub-hopper 42 to the supply auger 43 as well as the toner transfer auger 23 of the new toner replenishment unit 8 is operated for one second to thereby supply the new toner in the new toner hopper 18 to the supply auger 43 (step ST43). With this operation, the supply auger 43 replenishes the recovered toner and the new toner into the developing device 5 at a mixing ratio of 3:1.

Next, it is determined whether or not the new toner hopper 18 containing the new toner is empty (step ST44). When the new toner hopper 18 is not empty, the process returns to step ST40 and determines whether or not the toner ratio density in the developing device 5 is equal to or more than the prescribed value. When the toner ratio density is not the prescribed value or more, the process repeats the processing steps ST40, 43, and 44 and returns the toner ratio density to a value equal to or more than the prescribed value.

In contrast, when it is determined at step ST44 that the new toner hopper 18 containing the new toner is empty, the copy operation is stopped (step ST45), and it is displayed that the new toner hopper containing the new toner is empty (step ST46). Next, the process waits until new toner is replenished in the new toner hopper 18 (step ST47), and when the new toner is replenished, the process returns to step ST33 and repeats the above processing steps.

With the above operation, even if the new toner remains in a small amount, a period until the toner is exhausted can be extended similarly to the first embodiment. Accordingly, a large amount of copies can be made even after the new toner remains in the small amount.

In the above respective embodiments, only whether or not the new toner hopper 18 containing the new toner is empty is determined at step ST18 of FIG. 8 and at step ST44 of FIG. 9. However, the ratio of the amount of the recovered toner to be supplied to the new toner may be controlled stepwise according to the remaining amount of the new toner by accurately detecting it.

Otherwise, the user may switch between the toner save mode and the ordinary mode minutely by calculating the number of print possible sheets from the remaining amount of the toner detected accurately and by displaying the number of sheets on the control panel and the like.

Further, in the above respective embodiments, while only the means is executed which increases the ratio of the amount of the recovered toner, which is to be supplied into the developing device 5, to the new toner as the remaining amount of the new toner to be supplied into the developing device 5 reduces, additional means may be executed at second and third steps. That is, at a first step, the ratio of the amount of the recovered toner to be supplied to the amount of the new toner may be increased while maintaining the total amount of the recovered toner and the new toner constant to be supplied into the developing device 5 constant, and, at a second step, the total amount of the recovered toner and the new toner to be supplied may be reduced. Further, at a third step, the new toner to be supplied into the developing device 5 may be stopped and only the recovered toner may be supplied. While the above three means are ordinarily executed in the above sequence, they may be executed in a sequence in which the means are combined differently. One or two or more of these means may be combined and executed in any arbitrary sequence.

In a facsimile, when the number of print possible sheets, which is calculated from the remaining amounts of the new toner and the recovered toner, is less than the number of sheets received and stored in a memory, the ordinary mode is switched to the toner save mode so that the number of the print possible sheets is increased. Further, the number of the sheets stored in the memory may be set to the number of the print possible sheets, and the mixing ratio and the density of the new toner and the recovered toner may be calculated from the remaining amount of the toner so that the number of the sheets stored in the memory can be printed.

Further, in the toner save mode, the operation times of both the recovered toner replenishment auger 51 of the toner recycle device 9 and the toner transfer auger 23 of the new toner replenishment unit 8 may be reduced, in addition to that the ratio of the operation time of the recovered toner replenishment auger 51 to that of the toner transfer auger 23 is controlled. The number of the print possible sheets may be increased by reducing the total amount of the recovered toner and the new toner to be reduced by reducing the operation times of both the augers 51 and 23 while maintaining the ratio of the operation times of them. The operation times may be reduced stepwise. Specifically, as the remaining amount of the toner reduces, the number of the print possible sheets may be increased by gradually reducing an image density.

With this operation, the period until the toner is exhausted can be further extended.

In addition, in the above respective embodiments, the mixing ratio of the recovered toner is increased by operating the recovered toner replenishment auger 51 of the toner recycle device 9 for the three seconds and by operating the toner transportation auger 23 of the new toner replenishment unit 8 for one second in the toner save mode. However, the operation times of the recovered toner replenishment auger 51 and the like may be appropriately adjusted according to a target mixing ratio of the recovered toner.

Only a turning on/off button for setting and resetting the toner save mode may be disposed on the control panel as the toner save mode switch button, and the user may arbitrarily adjust the mixing ratio of the recovered toner. In this case, an analog knob a digital display adjuster may be disposed on the control panel to set the mixing ratio of the recovered toner from 0% to 100%.

Further, in the second embodiment, the toner save mode is automatically turned on when the new toner hopper is almost empty. However, it may be only displayed on the control panel and the like that the new toner hopper is almost empty. With this arrangement, when it is desired to extend the period until the toner is exhausted, the period can be extended by switching the ordinary mode to the toner save mode by manipulating the toner save mode switch button on the control panel by the user, and new toner is ordered during the extended period. When spare new toner is stored on hand, the new toner hopper is used in the ordinary mode, and the new toner is replenished after the new toner hopper becomes empty.

Moreover, while the number of rotation of the mag-roller 12 of the developing device 5 is reduced by about several percents than the ordinary number of rotation, the reduced number of rotation may be appropriately set according to the mixing ratio of the recovered toner in an extent in which the developing agent does not scatter.

Further, the amount of charge of the developing agent may be increased to prevent the scattering of the developing agent. In this case, when the amount of charge of the developing agent is increased by controlling the rotation of the mixer unit 5A in the developing device 5, the developing agent can be more easily absorbed by the photosensitive drum 2. As a result, the amount of the scattering developing agent can be reduced.

Any one or both of means for reducing the number of rotation of the mag-roller 12 and means for increasing the amount of charge may be executed.

While the copy machine is described as an example in the above respective embodiments, the present invention is by no means limited to the copy machine and can be applied to any other equipment for forming an image using toner such as a printer, a facsimile and the like.

Further, the present invention can be also applied to a color copy machine. In this case, the present invention is applied to each of four sets of the image forming apparatuses 1 for three primary colors and black. When the remaining amount of the developing agent of any one of the four image forming apparatuses 1 is reduced, the amount of toner to be supplied is adjusted according to the remaining amounts of the toner in another image forming apparatuses 1.

What is claimed is:

1. An image forming apparatus comprising:

a recovered toner hopper which temporarily stores recovered toner;

a coupling and transfer auger to transfer the recovered toner from a cleaner unit to the recovered toner hopper;

a recovered toner replenishment auger to replenish the recovered toner stored in the recovered toner hopper into a developing device;

a new toner hopper which stores new toner;

a new toner replenishment auger to replenish the new toner stored in the new toner hopper into the developing device;

a toner save mode setting key to set a toner save mode; and a controller configured to individually control the recovered toner replenishment auger and the new toner replenishment auger and to reduce, when the toner save mode is set, the amount of the new toner replenished into the developing device.

2. The image forming apparatus according to claim 1, wherein when the toner save mode is set, the controller increases the ratio of the amount of the recovered toner to be supplied to the amount of the new toner while maintaining the total amount of the recovered toner and the new toner to be supplied into the developing device constant.

3. The image forming apparatus according to claim 2, wherein the controller can arbitrarily adjust the ratio of the amount of the recovered toner to be supplied to the amount of the new toner.

4. The image forming apparatus according to claim 2, wherein the controller includes a sensor to detect the remaining amount of the new toner and adjusts the ratio of the amount of the recovered toner to be supplied to the amount of the new toner stepwise according to the remaining amount of the new toner.

5. The image forming apparatus according to claim 2, wherein the developing device has a mag-roller for holding toner, and when the toner save mode is set, the controller prevents the scattering of the toner by controlling the number of rotation of the mag-roller.

6. The image forming apparatus according to claim 2, wherein the developing device has a mixer unit for stirring the toner, and when the toner save mode is set, the controller increases the amount of charge of the toner by controlling the number of rotation of the mixer unit.

7. The image forming apparatus according to claim 1, wherein when the toner save mode is set, the controller reduces the total amount of the recovered toner and the new toner to be supplied into the developing device.

8. The image forming apparatus according to claim 1, wherein when the toner save mode is set, the controller stops the new toner to be supplied into the developing device and supplies only the recovered toner.

9. The image forming apparatus according to claim 8, wherein the developing device has a mag-roller for holding toner, and when a toner save mode is set, the controller prevents the scattering of the toner by controlling the number of rotation of the mag-roller.

10. The image forming apparatus according to claim 8, wherein the developing device has a mixer unit for stirring the toner, and when the toner save mode is set, the controller increases the amount of charge of the toner by controlling the number of rotation of the mixer unit.

11. An image forming apparatus comprising a recovered toner hopper which temporarily stores recovered toner;

a coupling and transfer auger to transfer the recovered toner from a cleaner unit to the recovered toner hopper;

a recovered toner replenishment auger to replenish the recovered toner stored in the recovered toner hopper into a developing device;

a new toner hopper which stores new toner;

a new toner replenishment auger to replenish the new toner stored in the new toner hopper into the developing device;

a toner save mode setting key to set a toner save mode; and a controller configured to individually control the recovered toner replenishment auger and the new toner replenishment auger and to execute, when the toner save mode is set, any one or two or more of a step of increasing the ratio of the amount of the recovered toner to be supplied to the amount of the new toner while maintaining the total amount of the recovered toner and the new toner to be supplied into the developing device constant, a step of reducing the total amount of the recovered toner and the new toner to be supplied into the developing device, and a step of stopping the new toner to be supplied into the developing device and supplying only the recovered toner.

12. An image forming method comprising transferring recovered toner from a cleaner unit to a recovered toner hopper which temporarily stores recovered toner;

replenishing the recovered toner stored in the recovered toner hopper into a developing device;

replenishing a new toner stored in a new toner hopper into the developing device;

setting a toner save mode; and reducing an amount of the new toner replenished into the developing device, if the toner save mode is set.

* * * * *